United States Patent [19]

DeWitt, deceased

[11] 4,060,940

[45] Dec. 6, 1977

[54] ADJUSTABLE GUARD CONSTRUCTION FOR CUT-OFF MACHINE

[75] Inventor: Erik John DeWitt, deceased, late of Lutherville, Md., by Carol Lynn Hartsock DeWitt, administratrix

[73] Assignee: The Black and Decker Manufacturing Company, Towson, Md.

[21] Appl. No.: 648,759

[22] Filed: Jan. 13, 1976

[51] Int. Cl.[2] ..... B24B 23/00

[52] U.S. Cl. ..... 51/170 PT; 51/268

[58] Field of Search ..... 51/170 PT, 170 T, 268, 51/271, 272, 273; 30/388, 390, 500

[56] References Cited

U.S. PATENT DOCUMENTS 2,301,264 11/1942 Emery ..... 51/268 X 2,954,653 10/1960 Harvey ..... 51/273

3,382,578 5/1968 Dobbertin ..... 51/268

*Primary Examiner*—James L. Jones, Jr.

*Attorney, Agent, or Firm*—Joseph R. Slotnik; Walter Ottesen; Edward D. Murphy

[57] ABSTRACT

A portable, electric cut-off machine including an electric motor powered abrasive disc. Front and rear handles are provided for convenient two-hand operation of the tool and are electrically isolated for operator protection. A protective guard encompasses substantially 210° of the abrasive disc and is adjustably mounted in novel fashion on the housing and one of the handles. A supporting shoe is adjustably attached to the guard. The tool is constructed so that parts may be reversed for either right-handed or left-handed operators.

9 Claims, 7 Drawing Figures

ADJUSTABLE GUARD CONSTRUCTION FOR CUT-OFF MACHINE

SUMMARY OF THE INVENTION

The present invention is directed to an improved front handle and abrasive disc guard assembly for a portable cut-off machine wherein the guard is securely clamped in place but may be released, adjusted about the abrasive disc, and reclamped without the use of tools. The front handle is electrically isolated from the motor and guard, and the guard and the front handle and associated structure are such as to permit quick and easy reversal of parts for use by both right-handed and left-handed operators. In addition, the device employs a relatively simple construction and one which employs relatively few loose parts, and therefore is designed for low cost and easy assembly in addition to being safe and reliable in use.

Other objects and advantages of the present invention will become more apparent from the consideration of the detailed description to follow taken in conjunction with the drawings annexed hereto.

DETAILED DESCRIPTION

Figure 1:
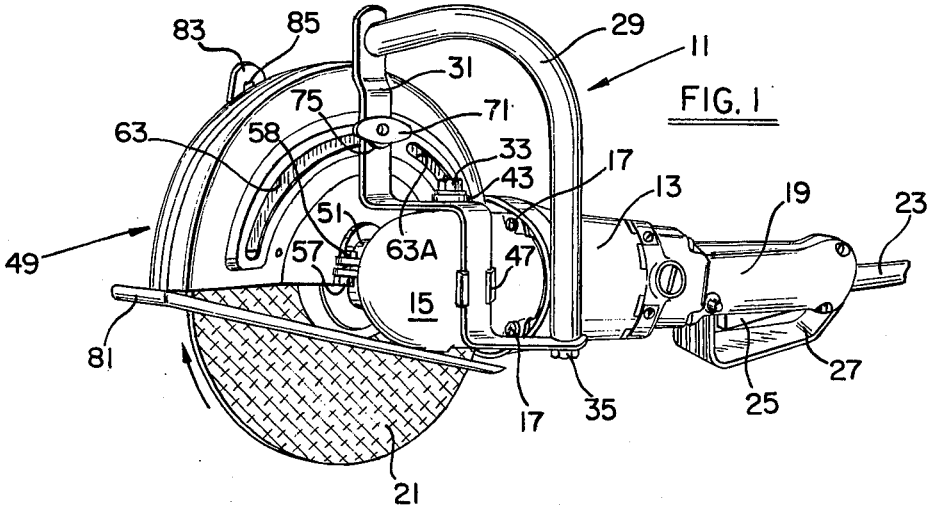
FIG. 1 is a perspective view showing a portable, electric cut-off machine embodying the present invention and shown assembled for a right-handed user.
Figure 5:
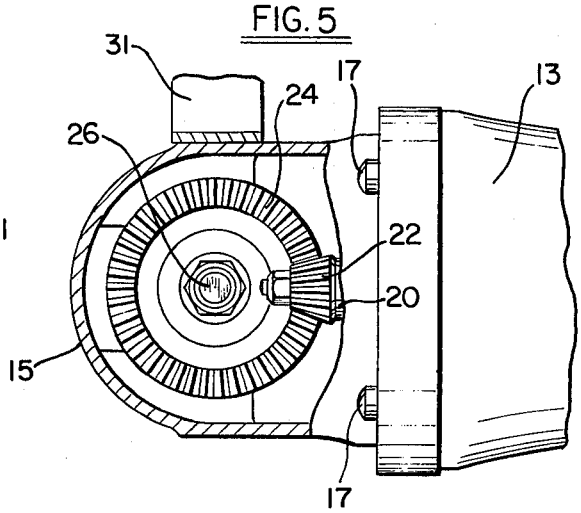
FIG. 5 is a sectional view of FIG. 2 taken along the line 5—5 thereof.

Referring now more specifically to the drawings, a portable, electric cut-off machine embodying the present invention is shown generally at 11 in FIG. 1 and is seen to include a motor housing 13 having a gear case 15 secured to its forward end by screws 17, and a handle 19 suitably secured to its rear end and electrically insulated therefrom. An electric motor (not shown) is disposed within the motor housing 13 and has an output shaft 20 drivingly connected to an abrasive disc 21 through bevel gears 22, 24, gear 24 being fixed to a spindle 26 which mounts disc 21. Electric current is supplied to the motor by a conventional line cord 23, and is controlled by a trigger 25 on the handle 19, so that when the line cord 23 is connected to a suitable power source and the trigger 25 actuated, the electric motor is energized and the abrasive disc 21 is caused to turn. A trigger guard 27 is provided on the handle 19 to prevent accidental actuation of the trigger 25.

The device shown in FIG. 1 is arranged for a right-handed operator such that the opeator's right hand will be placed upon the handle 19. An additional front handle 29, shown as constructed from a hollow steel pipe, is connected to the tool by means of a handle bracket 31 secured to the gear case 15 by a bolt 33. As shown, the handle 29 and bracket 31 are connected by bolts 35 threaded into steel plugs 37 pressed into opposite ends of the L-shaped handle 29. Bolt 33 threads directly into an opening 39 and the gear case 15. In addition, the handle bracket 31 is electrically isolated from the gear case 15 by a two-piece insulator 41, 43, part 41 being pressed into an opening 45 in the bracket 31, and part 43 being pressed onto part 41, and by a cushioning bumper 47 fixed to the bracket 31. The two-piece insulator 41, 43 may be constructed of Nylon, while the bumper 47 may be constructed of a soft rubber or rubber-like material.

A protecting guard generally illustrated at 49 encompasses substantially 210° of the abrasive wheel. Guard 49 includes a semi-cylindrical flange 51 secured to a hub 53 of the gear case 15 by a lower clamp 55 and bolts 57 and nuts 58. As shown, the flange 51 and lower clamp 55 have radially projecting ears 59, 61, respectively, through which the bolts 57 extend.

In addition, the guard 49 is provided with an arcuate slot 63. A carriage bolt 65 extends through the slot 63 and an opening 67 in the bracket 31, and is threaded into a sleeve 69 fixed to a knob 71. The bracket 31, and therefore the handle 29, is electrically insulated from the guard 49 and the carriage bolt 65 by a two-piece insulator, 73, 75 similar to parts 41, 43. Part 73 thus is pressed into the opening 67, and part 75 is pressed on part 73.

A supporting shoe 81 is provided with a pair of upstanding arms 83, 84 which are slotted at 85 for the reception of bolts 87 carried by the guard 49. Wing nuts 91 thread on the bolts 87 and adjustably secure the supporting shoe 81 in a selected vertical position. This shoe 81 provides support for the tool in that it rests upon the work surface during cutting action of the abrasive disc 21. Desirably, the abrasive disc 21 rotates in a clockwise direction, as seen in FIG. 1, so that as the wheel 21 penetrates the work surface at its leading edge, the shoe 81 is drawn against the work surface and absorbs the reaction forces. Abrasive particles and accompanying sparks are directed away from the operator with rotation as described.

One of the problems in tools of this type is that the guard 49 tends to become loosened during use as a result of vibration forces developed and/or from the guard 49 being struck or bumped during operation of the tool. In the present invention, the guard 49 is adapted to swivel about the axis of the gear case hub 53. The holding force on the guard 49 provided by the fasteners 57 is a tight frictional connection, but allows the guard 49 to be pivoted or swivelled manually about the axis of the hub 53. Thus, the fasteners 57 can be torqued at assembly, and not touched again. The true holding force for the guard 49 is provided by the interconnected knob 71 and carriage bolt 65.

The knob 71 is designed to be tightened and loosened, on the bolt by hand and without the use of tools; however, since the location of the bolt and knob 65, 71 is at a substantial radius from the axis of the hub 53, the connection between the bolt and knob, when tightened, forms a substantial moment arm which resists pivoting or swivelling of the guard 49. A strong holding force is achieved simply from manual tightening of the knob 71, and this is a substantial improvement over the prior art, many of which relied upon the tightening action and holding force in the area of the hub 53 such as would be provided by the bolts 57 and nuts 58. Furthermore, the two point fastening of the guard 49, formed by bolt and knob 69, 71, and bolts 57 and nuts 58, provides additional stability against tilting or canting of the guard 49 during use of the tool. This further ensures that the guard 49 will remain stable and tight in its adjusted position.

Figure 6:
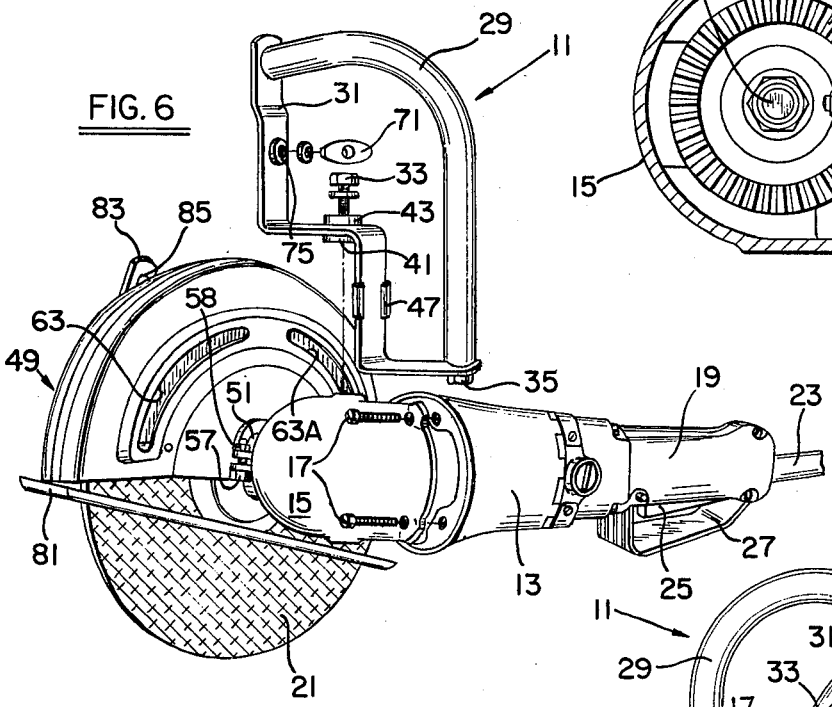
FIG. 6 is an exploded view of FIG. 1 showing the parts during change over for a left-handed user.
Figure 7:
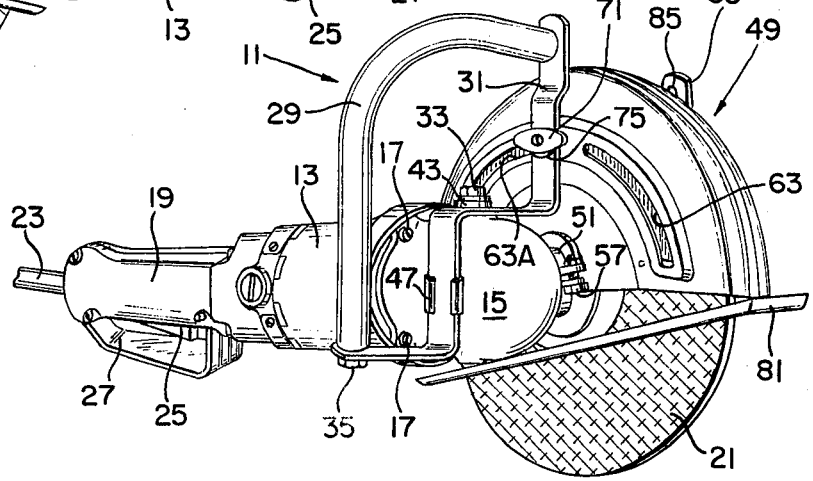
FIG. 7 is a view similar to FIG. 1 and showing the parts positioned for a left-handed user.
Figure 3:
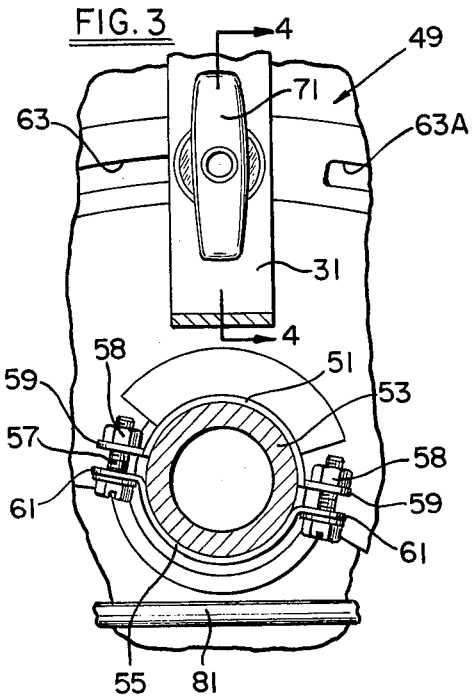
FIG. 3 is an enlarged sectional view of FIG. 2 taken along the line 3—3 thereof.
Figure 4:
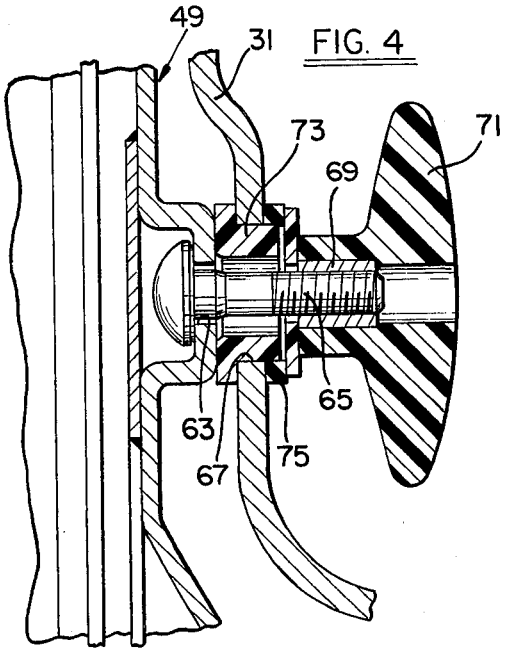
FIG. 4 is a sectional view of FIG. 3 taken along the line 4—4 thereof.
Figure 2:
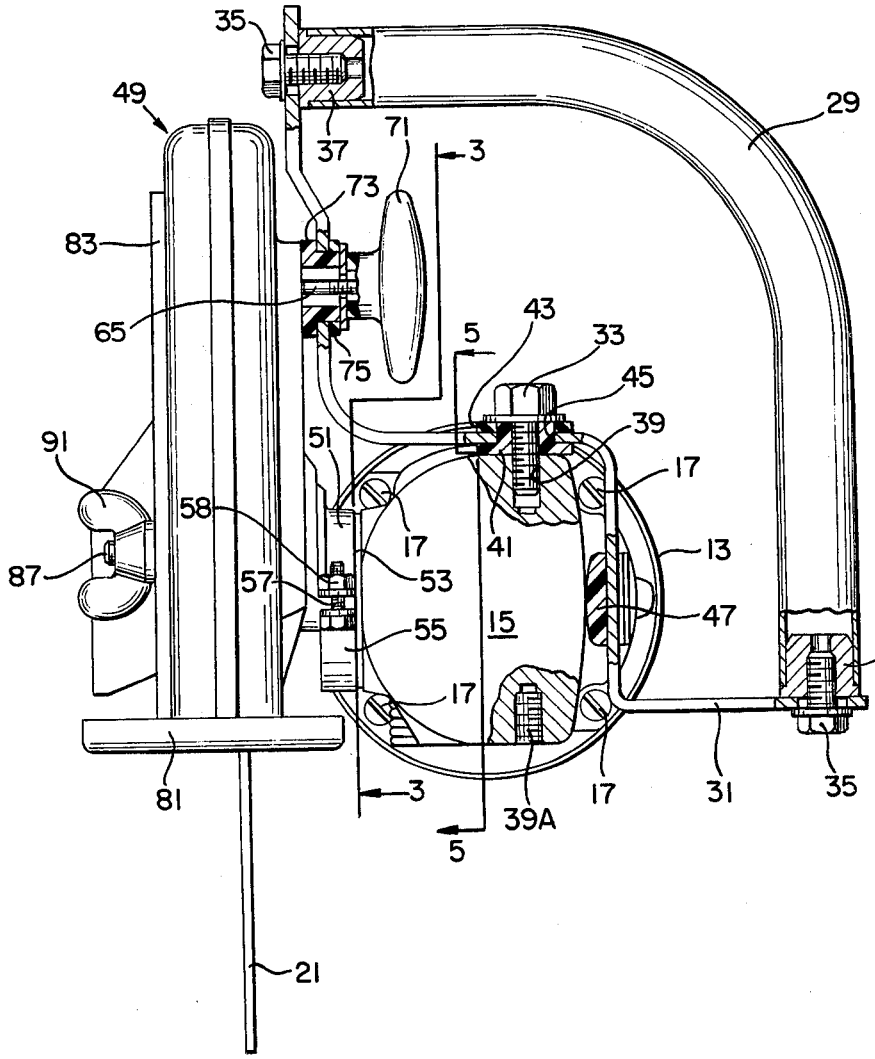
FIG. 2 is an enlarged end view of the construction of FIG. 1 partly in section to illustrate some features of the present invention.

An additional feature of the present invention resides in the fact that the rotation can be reversed. This would accommodate use by left-handed operators (as well as right-handed ones). Furthermore, it would accommodate applications where the "plunge cutting" technique is preferred by the operator, well as right-handed ones). Furthermore, it would accommodate applications where the "plunge cutting" technique is preferred by the operator, i.e., where the wheel penetrates the work surface at its lower edge as opposed to its leading edge. Such an application might be desirable for rescue operations since the abrasive particles and sparks could then be directed towards the operator but away from trapped victims. Should it be desired to arrange this construction for reverse rotation, it is only necessary to do the following:

First, the motor brushes are removed. Then, the four screws 17 holding gear housing 15 to motor housing 13 are removed, as shown in FIG. 6, the gear housing 15 and the gear housing cover are rotated 180° as a unit with respect to the motor housing 13, and the screws 17 reinserted into the realigned openings to refasten the gear housing 15 and motor housing 13. It will be appreciated that the bevel gear transmission 22, 24 allows this reorientation of the housings 13, 15.

The bolt 33 is removed from the opening 39, knob 71 is unscrewed from the carriage bolt 65, and handle 29 and bracket 31 are removed as a unit. The guard 49, without loosening bolts 57 and nuts 58, is manually rotated 180° on hub 53. Handle 29 and bracket 31 subassembly is positioned on the relocated gear case 15 and against guard 49, and bolt 33 is now threaded into tapped opening 39A in gear case 15. The carriage bolt 65 is inserted through another arcuated slot 63A in the guard 49 and knob 71 is tightened on bolt 65.

It will be appreciated that in both the right-hand and left-hand modes, the guard 49 is securely positioned throughout its full range of adjustment, which is nearly 90° as allowed by arcuate slots 63, 63A, respectively. To readjust the guard 49, only knob 71 is loosened, whereupon guard 49 can be manually turned on hub 53, and knob 71 retightened. Bolts 57 which are torqued during assembly of the tool, to provide the proper friction connection at hub 53, need never be touched. This is true even if the tool parts are repositioned to change over from right-hand to left-hand use as described above.

The widely spaced, two point mounting of the guard 49, provided by bolt and knob 65, 71, and clamp 51, 55 greatly stabilizes the guard 49 during use of the tool to further prevent the guard 49 from becoming loose or moving.

Finally, the handle 29 and bracket 31 are both eletrically insulated from the gear case 15 and guard 49 by insulators 41, 43 and 73, 75 which are permanently attached to bracket 31.

By the present invention, there has been disclosed an improved cut-off machine calculated to fulfill the inventive objects hereinabove set forth. While a preferred embodiment of the present invention has been illustrated and described in detail, it will be appreciated that various additions, substitutions, modifications and omissions may be made thereto without departing from the spirit of the invention.

I claim:

1. A circular cut-off machine comprising a housing having an electric motor therein, transmission means interconnecting said electric motor and an output spindle, an abrasive disc fixed to said output spindle, handle means for said tool including a first handle positioned rearwardly of said housing and a second handle connected to said housing so as to be positioned at the forward end portion thereof and adjacent said abrasive disc, a protective guard for said abrasive disc including a guard encompassing a portion of said disc, said guard being supported upon said housing adjacent said output spindle and adjustable about the axis of said spindle, and means associated with said second handle and releasably secured to said guard at a position radially spaced from said spindle axis for rigidly securing said guard in its adjusted position to said housing through said second handle.

2. A circular cut-off machine comprising a housing having an electric motor therein, transmission means interconnecting said electric motor and an output spindle, an abrasive disc fixed to said output spindle, handle means for said tool including a first handle positioned rearwardly of said housing and a second handle positioned forwardly of said housing adjacent said abrasive disc, a protective guard for said abrasive disc including a guard encompassing a portion of said disc, said guard being supported upon said housing adjacent said output spindle and adjustable about the axis of said spindle, a bracket fixed to said second handle, means releasably securing said bracket to said housing and to said guard at a position radially spaced from said spindle axis, whereby to rigidly secure said guard in its adjusted position.

3. A circular cut-off machine comprising a housing having an electric motor therein, transmission means interconnecting said electric motor and an output spindle, an abrasive disc fixed to said output spindle, handle means for said tool including a first handle positioned rearwardly of said housing and a second metal handle positioned forwardly of said housing adjacent said abrasive disc, a protective guard for said abrasive disc including a guard encompassing a portion of said disc, said guard being supported upon said housing adjacent said output spindle and adjustable about the axis of said spindle, a metal bracket fixed to said second handle, means releasably securing said bracket to said housing and to said guard at a position radially spaced from said spindle axis, said releasable securing means including electrical insulating means isolating said second handle and bracket from said housing and said guard, whereby to rigidly secure said guard in its adjusted position.

4. A circular cut-off machine comprising a housing having an electric motor therein, transmission means interconnecting said electric motor and an output spindle, an abrasive disc fixed to said output spindle, a handle connected to said housing so as to be positioned adjacent said abrasive disc, a protective guard for said abrasive disc including a guard encompassing a portion of said disc, said guard being supported upon said housing adjacent said output spindle and adjustable about the axis of said spindle, and means including electrical insulation means associated with said handle and releasably secured to said guard at a position radially spaced from said spindle axis for electrically isolating said handle from said guard and for rigidly securing said guard in its adjusted position.

5. A circular cut-off machine comprising a housing having an electric motor therein, transmission means interconnecting said electric motor and an output spindle, an abrasive disc fixed to said output spindle, a handle connected to said housing and positioned adjacent said abrasive disc, a protective guard for said abrasive disc including a guard encompassing a portion of said disc, said guard being supported upon and frictionally attached to said housing adjacent said output spindle, said guard being manually movable to overcome said frictional attachment to thereby adjust said guard about the axis of said spindle, and means associated with said handle and releasably secured to said guard at a position radially spaced from said spindle axis for rigidly securing said guard in its adjusted position.

6. A circular cut-off machine comprising a housing having an electric motor therein, transmission means interconnecting said electric motor and an output spindle, an abrasive disc fixed to said output spindle, handle means for said tool including a first handle connected to said housing so as to be positioned rearwardly thereof and a second handle connected to said housing adjacent said abrasive disc, a protective guard for said abrasive disc including a guard encompassing a portion of said disc, said guard being supported upon said housing adjacent said output spindle and adjustable about the axis of said spindle, and means associated with said second handle and releasably secured to said guard at a position radially spaced from said spindle axis for rigidly securing said guard in its adjusted position, said second handle, said abrasive disc, and said guard being readily repositionable relative to said housing.

7. A circular cut-off machine comprising a housing including a motor housing and gear case, an electric motor in said motor housing and having an output shaft, a gear train in said gear case and driven by said output shaft, a spindle driven by said gear train and having an abrasive disc fixed thereto, a cylindrical hub on said gear case surrounding said spindle, a guard encompassing the upper portion of said disc and frictionally clamped to said hub for adjustment about the axis of said spindle, a first handle fixed to said motor housing, a second handle supported upon said gear case, means releasably connecting said second handle to said guard at a point spaced from said hub for rigidly securing said guard in its adjusted position, said guard being adjustable about said hub by releasing only said releasable connecting means and manually overcoming said frictional clamping force.

8. A circular cut-off machine comprising a housing including a motor housing and gear case, an electric motor in said motor housing and having an output shaft, a gear train in said gear case and driven by said output shaft, a spindle driven by said gear train and having an abrasive disc fixed thereto, a guard encompassing the upper portion of said disc and supported on said housing for adjustment about the axis of said spindle, a first handle fixed to said motor housing, a second handle constructed of metal supported through a bracket upon said gear case, means releasably connecting said bracket to said guard at a point spaced from said spindle, whereby to rigidly secure said guard in its adjusted position; said second handle being electrically insulated from said housing and said guard.

9. A circular cut-off machine comprising a housing including a motor housing and gear case, an electric motor in said motor housing and having an output shaft, a gear train in said gear case and driven by said output shaft, a spindle driven by said gear train and having an abrasive disc fixed thereto, a guard encompassing the upper portion of said disc and supported on said housing for adjustment about the axis of said spindle, a first handle fixed to said motor housing, a second handle constructed of metal supported through a metal bracket upon said gear case, means releasably connecting said bracket to said guard at a point spaced from said spindle, whereby to rigidly secure said guard in its adjusted position; electrical insulators permanently fixed to said bracket and electrically insulating said bracket and said second handle from said gear case and said guard.

* * * * *